US009382604B2

(12) United States Patent
Kurahashi et al.

(10) Patent No.: US 9,382,604 B2
(45) Date of Patent: Jul. 5, 2016

(54) APPARATUS AND METHOD FOR FORMING AMORPHOUS COATING FILM

(75) Inventors: Ryurou Kurahashi, Osaka (JP); Masahiro Komaki, Osaka (JP); Tsunehiro Mimura, Osaka (JP)

(73) Assignee: NAKAYAMA AMORPHOUS CO., LTD., Osaka (JP)

( * ) Notice: Subject to any disclaimer, the term of this patent is extended or adjusted under 35 U.S.C. 154(b) by 971 days.

(21) Appl. No.: 13/521,539

(22) PCT Filed: Jan. 13, 2010

(86) PCT No.: PCT/JP2010/050265

§ 371 (c)(1),
(2), (4) Date: Sep. 12, 2012

(87) PCT Pub. No.: WO2011/086669

PCT Pub. Date: Jul. 21, 2011

(65) Prior Publication Data

US 2013/0011570 A1 Jan. 10, 2013

(51) Int. Cl.

| | |
|---|---|
| ***B05B 7/20*** | (2006.01) |
| ***B05B 7/16*** | (2006.01) |
| ***B05D 1/10*** | (2006.01) |
| ***B05C 11/00*** | (2006.01) |
| ***C23C 4/06*** | (2016.01) |
| ***C23C 4/12*** | (2016.01) |
| ***C23C 4/14*** | (2016.01) |
| *B05B 7/22* | (2006.01) |

(52) U.S. Cl.

CPC ..... *C23C 4/06* (2013.01); *B05B 7/1606* (2013.01); *B05B 7/201* (2013.01); *B05B 7/205* (2013.01); *C23C 4/12* (2013.01); *C23C 4/129* (2016.01); *C23C 4/14* (2013.01); *B05B 7/226* (2013.01)

(58) Field of Classification Search

None

See application file for complete search history.

(56) References Cited

U.S. PATENT DOCUMENTS

| | | | | |
|---|---|---|---|---|
| 5,014,915 | A * | 5/1991 | Simm | C23C 4/124 219/121.47 |
| 5,151,308 | A * | 9/1992 | Moskowitz et al. | 428/35.8 |
| 5,207,382 | A | 5/1993 | Simm et al. | |
| 5,384,164 | A * | 1/1995 | Browning | 239/83 |

(Continued)

FOREIGN PATENT DOCUMENTS

| | | |
|---|---|---|
| JP | A-2000-507648 | 6/2000 |
| JP | A-2001-214252 | 8/2001 |

(Continued)

OTHER PUBLICATIONS

Extended European Search Report issued in European Patent Application No. 10843028.1 on Aug. 5, 2014.

(Continued)

*Primary Examiner* — Binu Thomas

(74) *Attorney, Agent, or Firm* — Oliff PLC

(57) ABSTRACT

An apparatus for forming an amorphous coating film by jetting flame containing particles of a flame spray material from a flame spray gun toward a base material, causing the particles to be melted by the flame, and cooling both the particles and the flame with the means of a cooling gas before they reach the base material. The apparatus includes a tubular member provided among the path along which the flame is jetted that it surrounds the flame passing through a melting zone in which the particles are melted. The tubular member has a flow channel for the cooling gas, formed along and integrally to the tubular member.

9 Claims, 10 Drawing Sheets

(56) References Cited

U.S. PATENT DOCUMENTS

| | | | | |
|---|---|---|---|---|
| 5,932,293 | A * | 8/1999 | Belashchenko et al. | 118/308 |
| 6,245,390 | B1 | 6/2001 | Baranovski et al. | |
| 2009/0246398 | A1 * | 10/2009 | Kurahashi et al. | 118/47 |

FOREIGN PATENT DOCUMENTS

| | | |
|---|---|---|
| JP | A-2005-126795 | 5/2005 |
| JP | A-2006-159108 | 6/2006 |
| JP | A-2006-214000 | 8/2006 |
| JP | A-2007-023332 | 2/2007 |
| JP | A-2008-43869 | 2/2008 |
| JP | A-2010-022895 | 2/2010 |
| KR | 2000-0076238 | 12/2000 |
| KR | 10-0660220 | 12/2006 |

OTHER PUBLICATIONS

Oct. 29, 2013 Office Action issued in Korean Patent Application No. 10-2012-7017909 (with translation).

Nov. 20, 2013 Office Action issued in Russian Patent Application No. 2012134332 (with translation).

Jun. 15, 2010 International Search Report issued in Application No. PCT/JP2010/050265 (with translation).

Aug. 7, 2012 International Preliminary Report on Patentability issued in Application No. PCT/JP2010/050265 (with translation).

* cited by examiner (a)

CONVENTIONAL IMPELLER AFTER USE FOR 11 MONTHS (b)

IMPELLER FLAME-SPRAY COATED WITH AMORPHOUS FILM AFTER USE FOR 5 MONTHS

APPARATUS AND METHOD FOR FORMING AMORPHOUS COATING FILM

TECHNICAL FIELD

The present invention relates to an apparatus and a method for forming an amorphous coating film on a surface of a base material (substrate) by flame spray coating.

BACKGROUND ART

High-velocity oxy-fuel (HVOF) flame spray coating is known as a technique for forming an amorphous phase on a surface of a base material. This technique is as follows. By feeding a fuel and an oxygen gas from the body of a flame spray gun, flame (gas flame) is jetted forward at a high velocity. Particles (powder) of a flame spray material are fed to the flame with the use of a carrier gas. The particles fed to the flame are heated while being accelerated in the flame, strike a surface of a base material along with the flame, and are cooled to be solidified on the surface. Thus, an amorphous coating film is formed on the surface of the base material depending on the type of the metal, which is determined by the components of the particles, and on the cooling speed at which the particles are cooled and solidified. The following Patent Documents 1 and 2 describe high-velocity oxy-fuel flame spray coating.

In this high-velocity oxy-fuel flame spray coating, the particles dwell in the flame only for a short time, so that they are difficult to be melted completely. Moreover, the temperature of the base material rises, so that the cooling speed tends to become lower. For these reasons, materials that can be used to form amorphous coating films have been limited only to those metals whose melting points are low and whose abilities to become amorphous are great. For example, metal glasses with melting points of about 1200K or less and supercooling temperature ranges of 50K or more come under such metals.

The following Patent Document 3 describes an apparatus that makes it possible to use a variety of metals, not limited to metal glasses, to form amorphous coating films. This apparatus is illustrated in FIG. 12 in the drawings attached hereto. Flame F containing particles of a flame spray material is jetted from a flame spray gun 10' toward a base material M, and a cooling gas G is blown around the flame F. The cooling gas G is not only blown along a nozzle 11' of the flame spray gun 10', but also ejected from a plurality of conduits 20' provided around the flame F so as to come close to the flame F. In such an apparatus for flame spray coating, since the flame F is cooled before it reaches the base material M, the particles of the flame spray material can readily become amorphous. Therefore, even with the use of a metal having a high melting point and a narrow supercooling temperature range as a flame spray material, it is possible to form an amorphous coating film on the base material M.

Patent Document 1: JP 2006-159108A
Patent Document 2: JP 2006-214000A
Patent Document 3: JP 2008-43869A In the apparatus described in Patent Document 3, there is still room for improvement in respect of the following points.

a) There is a space between each two of the conduits 20' shown in FIG. 12, so that the flame F is partly exposed to an atmospheric air in the stage where particles of the flame spray material are melted (the stage before the particles are cooled by means of the cooling gas). The particles, therefore, tend to undergo oxidation.

b) A plurality of the conduits 20', protruded around the path along which the flame F is jetted, inevitably make the apparatus large in size. Although on-site operation can be done with the apparatus, it is not easy to handle the apparatus.

DISCLOSURE OF THE INVENTION

In order to improve the above-described points, the present invention was accomplished. Namely, the present invention provides an apparatus and a method for forming an amorphous coating film, having the following advantages: a variety of metals, including metals having high melting points and narrow supercooling temperature ranges, can be used to form amorphous coating films; the apparatus can be made compact; and production of oxides is suppressed.

An apparatus for forming an amorphous coating film according to the present invention is an apparatus for forming an amorphous coating film by jetting flame containing particles (powder) of a flame spray material from a flame spray gun toward a base material, causing the particles to be melted by the flame, and cooling both the particles and the flame by means of a cooling gas before they reach the base material, comprising a tubular member provided at a melting zone (nearly the first half of a path along which the flame is jetted), in which the particles are melted, among a path along which the flame is jetted by the flame spray gun, so as to shield the flame from an atmospheric air in the melting zone; the tubular member has a flow channel for the cooling gas, formed along and integrally to the tubular member. Any conventional powder flame spray gun can be used as the flame spray gun. Any of a nitrogen gas, inert gases, air, gases mixed with fine droplets (mist) of liquids, and other gases can be used as the cooling gas, as will be described later.

The apparatus for forming an amorphous coating film, having the above characteristic features, has the following effects.

a) The tubular member is provided at a specific part among the path along which the flame is jetted, as described above, so as to shield the flame from the atmospheric air. The particles, therefore, scarcely undergo oxidation in the stage where they are melted, which leads to the suppression of production of oxides in an amorphous coating film.

b) Since the flow channel for the cooling gas is formed along and integrally to the tubular member, it is not necessary to provide bulky conduits or the like for the cooling gas around the path along which the flame is jetted. This makes the apparatus compact. The apparatus is therefore easy to be handled and makes on-site formation of amorphous coating films easy.

It is preferred that the flow channel be formed such that the cooling gas emerging therefrom flows tubularly around an entire periphery of the flame (nearly the latter half of the path along which the flame is jetted: a quenching zone). It is particularly preferred that the cooling gas flow out of the tubular member without intermission to form a continuous stream.

When the tubular member has the above-described flow channel, the particles and the flame are evenly cooled from the outer side in the quenching zone in which they are cooled, and also the particles are particularly surely prevented from oxidation depending on the type of the cooling gas used. There is thus formed an amorphous coating film of particularly high grade, excellent in corrosion resistance, etc.

Preferably, the tubular member has coaxial two cylindrical pipes whose distal ends are open, such that the cooling gas flows between the two pipes and ejected from between the distal ends (or their vicinity) of the two pipes (e.g., in a direction parallel to the flame).

Such a tubular member itself is suitably cooled by an effect of the cooling gas that flows between the two coaxial pipes. The tubular member, therefore, is not damaged thermally by the flame, even if it is not made of a special heat-resistant metal. Moreover, since the cooling gas flows between the two pipes and ejected from between the distal ends of the two pipes, the tubular member and the flow channel for the cooling gas can be compactly integrated to each other. This makes the apparatus small in size and its handling particularly easy. It is also made possible that the cooling gas flows tubularly around the entire periphery of the flame, as described above.

It is preferred that a sectional area of the opening between the distal ends of the two pipes be smaller than that of the opening between bodies of the two pipes. In order to attain this, e.g., partition members may be placed between the distal ends of the two pipes, thereby making a spray nozzle with slits.

By making the sectional area of the opening between the distal ends of the two pipes smaller than that of the opening between bodies of the two pipes, it is possible to eject the cooling gas at an increased flow rate. The cooling gas ejected at an increased flow rate flows without being deviated greatly from its path by the flame, so that it can cool the flame intensely and effectively.

It is particularly preferred that a nitrogen gas or an inert gas such as an argon gas be used as the cooling gas.

The use of the above-described gas having low reactivity as the cooling gas prevents the melted particles from coming into contact with an oxygen gas even in the quenching zone in which the particles are cooled. This leads to suppression of production of oxides in an amorphous coating film. When the production of oxides is more suppressed, an amorphous coating film of higher grade, more excellent in corrosion resistance, etc. is formed.

Preferably, the tubular member has a proximal end which is connected to the flame spray gun, and the proximal end or the vicinity thereof can be opened (so that the inside of the tubular member can communicate with the atmospheric air) for an ignition of the flame spray gun, and can also be closed.

If the flame spray gun is provided with the above tubular member on its front, it is not easy to ignite a fuel gas for allowing the flame spray gun to start to jet flame. This is because a fuel and air (an oxygen gas) do not always exist in the tubular member in a suitable mixing ratio. If the proximal end of the tubular member, or the vicinity thereof, is made openable as described above, the fuel injected little by little is mixed with the atmospheric air moderately. This makes the ignition of the fuel easy. If a sparkplug or the like is provided in the vicinity of the above-described openable end (on the tubular member, or on the flame spray gun, or between the two), the ignition of the fuel can be done more easily. After the fuel has been ignited, the proximal end of the tubular member is closed, and the fuel is made to burn with an oxygen gas that is separately fed from the flame spray gun.

It is preferred that the tubular member be replaceable with one having a different length.

The optimum length of the tubular member varies depending on e.g., the melting point of a metal that is used to form an amorphous coating film. When a metal with a higher melting point is used as a flame spray material, it will take a longer time to melt its particles, and thus it is proper to use a longer tubular member. If the tubular member is replaceable with one having a different length as described above, it is possible to use a tubular member with a length optimal to a metal that is used to form an amorphous coating film.

Preferably, the apparatus has, between the tubular member and the flame spray gun, air-intake vents or inert-gas-feed openings effective in suppressing development of a negative pressure in the tubular member.

With respect of the development of a negative pressure, the inventors of the present invention conducted some tests and found the following. If a negative pressure is developed in the tubular member, flows of gas and flame in the tubular member are disturbed, and the particles are deposited on the inner surface of the tubular member; this hampers the continuous operation of the apparatus. If the tubular member or the flame spray gun has air-intake vents (or inert-gas-feed openings) as described above, air (or an inert gas) flows into the tubular member in a proper amount depending on the inner pressure of the tubular member (or by being somehow regulated), whereby the development of a negative pressure in the tubular member is suppressed. The possibility that the deposition of the particles on the inner surface of the tubular member will hamper the continuous operation of the apparatus is thus eliminated, and the continuous and smooth operation of the apparatus is made possible.

Preferably, a temperature of an outer part of the flame, surrounding a center part at the flame within a diameter of 10 mm, is not higher than a vitrification temperature of a metal that is used in the form of particles of the flame spray material, when the flame reaches the base material.

In conventional powder flame spray coating, flame jetted from a flame spray gun is not cooled down sufficiently, so that the temperature of the flame is generally high even when the flame reaches a base material. Namely, the temperature of a large part of the flame within a diameter of e.g., about 30 mm or more, including the center part of the flame, is higher than the vitrification temperature of the metal that is used in the form of particles of the flame spray material, when the flame reaches a base material. In this conventional technique, therefore, if the flame is continuously and concentrically applied to a certain part of the base material, the temperature of the base material rapidly increases and exceeds the vitrification temperature of the metal within less than about ten seconds. For this reason, it is impossible to form an amorphous coating film on the base material unless a metal whose melting point is considerably low and whose ability to become amorphous is great is used as a flame spray material, or the apparatus (flame spray gun) is moved relative to the base material in a direction parallel to the surface of the base material at a very high velocity. Moreover, when the velocity of this movement is high, even if it is possible to form an amorphous coating film, it is not easy to make the thickness of the coating film large.

If the temperature of the outer part of the flame, surrounding the center part of the flame within a diameter of 10 mm, is controlled so that it does not exceed the vitrification temperature, even a metal whose melting point is high and whose ability to become amorphous is poor (i.e., whose supercooling temperature range is narrow) can be made amorphous. Moreover, the rise in temperature of the base material is suppressed by the effect of the outer part of the flame with a lower temperature. Therefore, moving the apparatus relative to the base material in the above-described direction at a considerably low velocity is enough to form an amorphous coating film on the base material (in some cases, the relative movement may be stopped). This makes on-site operation extremely easier.

A method of forming an amorphous coating film according to the present invention is a method of forming an amorphous coating film comprising the step of applying flame and particles of a flame spray material to a specific part of a base material (to the same part without relative movement) with the use of any of the above-described apparatus for forming an amorphous coating film, wherein the flame and the particles are cooled with the use of the cooling gas such that a surface temperature of the specific part of the base material (including a center part of the base material within a diameter of 10 mm) can be kept at a temperature equal to or lower than a vitrification temperature of a metal that is used in the form of particles of the flame spray material for a period of 10 seconds or more (desirably 30 seconds or more).

The above-described method makes it easy to form an amorphous coating film even with the use of a metal whose melting point is high and whose ability to become amorphous is poor. The rise in temperature of the base material due to the flame striking it is fully suppressed, so that the apparatus can be moved relative to the base material at a considerably low velocity. This makes on-site operation very easy.

In the above-described method for forming an amorphous coating film, it is also preferred that not only the flame but also the base material is cooled with the use of a cooling gas so that a surface temperature of the specific part of the base material can be kept at a temperature equal to or lower than a vitrification temperature of a metal that is used in the form of particles of the flame spray material for a period of 10 seconds or more (desirably 30 seconds or more).

Namely, by cooling the base material, in addition to the flame, with a cooling gas, the rise in temperature of the base material is suppressed. Also in this case, even a metal whose melting point is high and whose ability to become amorphous is poor can easily form an amorphous coating film on the base material. For example, the apparatus can be moved relative to the base material at a considerably low velocity, and this makes on-site operation quite easy.

It is preferable to control the surface temperature at any spot on the base material so that it does not exceed a vitrification temperature of a metal that is used in the form of particles of the flame spray material, by moving the apparatus relative to the base material in a direction parallel to a surface of the base material, while conducting cooling. The expression "in a direction parallel to" used herein is applicable not only to the case where the apparatus and the base material are perfectly parallel to each other, but also to the case where the two are almost parallel to each other as long as the suppression of the rise in temperature of the base material can be achieved.

If the cooling of the flame (or the flame and the base material) is conducted, the above-described relative movement may be conducted at a lower velocity. In this case, the formation of an amorphous coating film on the base material becomes quite easier if the surface temperature at any spot on the base material is controlled such that it does not exceed the vitrification temperature of the metal that is used in the form of particles, by properly setting the intensity of cooling and the velocity of the relative movement. Namely, the metal that has been jetted from the flame spray gun together with the flame and melted by the flame is cooled effectively before it strikes the base material, so that even a metal whose melting point is high and whose ability to become amorphous is poor can easily form an amorphous coating film. Another advantage is that since the rise in temperature of the base material is small, the use of a material poor in mechanical properties, etc. at high temperatures as the base material is made possible.

Along with the use of the above-described apparatus, it is particularly preferable to use, as the above-described flame, reducing flame that is formed with the use of an increased amount of acetylene and a decreased amount of oxygen.

The use of reducing flame leads to suppression of production of oxides in an amorphous coating film. When the production of oxides is more suppressed, an amorphous coating film of higher grade, more excellent in corrosion resistance, etc. is formed. It is more preferable to use reducing flame as the flame and a nitrogen gas or an inert gas as the cooling gas.

When using the above apparatus, it is preferred that the cooling gas in a quenching zone, in which the flame is cooled, has a flow rate which is nearly equal to that of the flame (about ±20% of the flow rate of the flame).

For cooling the flame and the particles with greater intensity, it is usually advisable to increase the flow rate of the cooling gas. But the inventors of the present invention conducted some tests and found the following. If the flow rate of the cooling gas is made excessively high by raising the pressure of the cooling gas, a negative pressure is developed in the tubular member, and the gas flow in the tubular member is disturbed. This makes the continuous operation of the apparatus difficult, as mentioned previously. It is possible to solve this problem caused by the development of a negative pressure in the tubular member, by allowing a large amount of the atmospheric air to flow into the tubular member. The atmospheric air flowing into the tubular member in a relatively large amount, however, tends to cause production of oxides more frequently. It is therefore preferable to make the flow rate of the cooling gas nearly equal to that of the flame, as described above. If the flow rate of the cooling gas is so regulated, a strong negative pressure is not developed in the tubular member, and moreover, such a trouble that an excess amount of the atmospheric air flows into the tubular member is not caused.

In the apparatus for forming an amorphous coating film according to the present invention, oxidation of particles of a flame spray material is suppressed, so that an amorphous coating film of high grade is formed. Moreover, the apparatus can be made compact, which makes its handling easy.

If the proximal end of the tubular member, which is connected to the flame spray gun, or the vicinity thereof, is openable, an operation for igniting the flame spray gun to start to jet flame can be easily done.

If air-intake vents are provided at proper points between the tubular member and the flame spray gun, development of a negative pressure in the tubular member is suppressed. The particles are therefore prevented from depositing on the inner surface of the tubular member, which allows the continuous operation of the apparatus.

If the temperature of the flame reaching the base material is controlled such that the outer part of the flame has a temperature equal to or lower than the vitrification temperature of the metal that is used in the form of particles of a flame spray material, the rise in temperature of the base material is suppressed, and even a metal whose melting point is high and whose ability to become amorphous is poor can readily become amorphous.

In the method of forming an amorphous coating film according to the present invention, the rise in a surface temperature of a base material is suppressed by the use of the above-described apparatus for forming an amorphous coating film. The method according to the invention, therefore, can be advantageously employed to form an amorphous coating film with the use of a metal whose melting point is high and whose ability to become amorphous is poor.

Especially when reducing flame is used as the flame, the oxidation of the material particles can be suppressed in an amorphous coating film. An amorphous coating film of high grade can thus be formed.

Besides, if the flow rate of the cooling gas is made nearly equal to that of the flame, the continuous operation of the apparatus is not hampered, and the oxidation of the material particles is suppressed in an amorphous coating film.

BRIEF DESCRIPTION OF THE DRAWINGS

FIG. 1(*a*) is a side view, partly in cross section, of the apparatus 1, and FIG. 1(*b*) is a plan view of the apparatus 1, with a tubular member 20 made to slide to open its proximal end.

FIG. 4(*a*-2) is a graph showing a rise in temperature of the base material when the temperature distribution of flame F is as shown in FIG. 4(*a*-1), and FIG. 4(*b*-2) is a graph showing a rise in temperature of the base material when the temperature distribution of flame is as shown in FIG. 4(*b*-1).

FIGS. 9 (*b*-1) to (*b*-3) are photomicrographs showing the results of an electrolytic corrosion test using oxalic acid, conducted on an amorphous coating film formed by an apparatus according to the invention.

FIG. 10(*a*) is a photo of a conventional impeller and shows the external appearance of the impeller after use for a certain period of time, and FIG. 10(*b*) is a photo of an impeller, coated with an amorphous coating film formed by an apparatus according to the present invention, and shows the appearance of the impeller after use for a certain period of time.

BEST MODE FOR CARRYING OUT THE INVENTION

Figure 1:
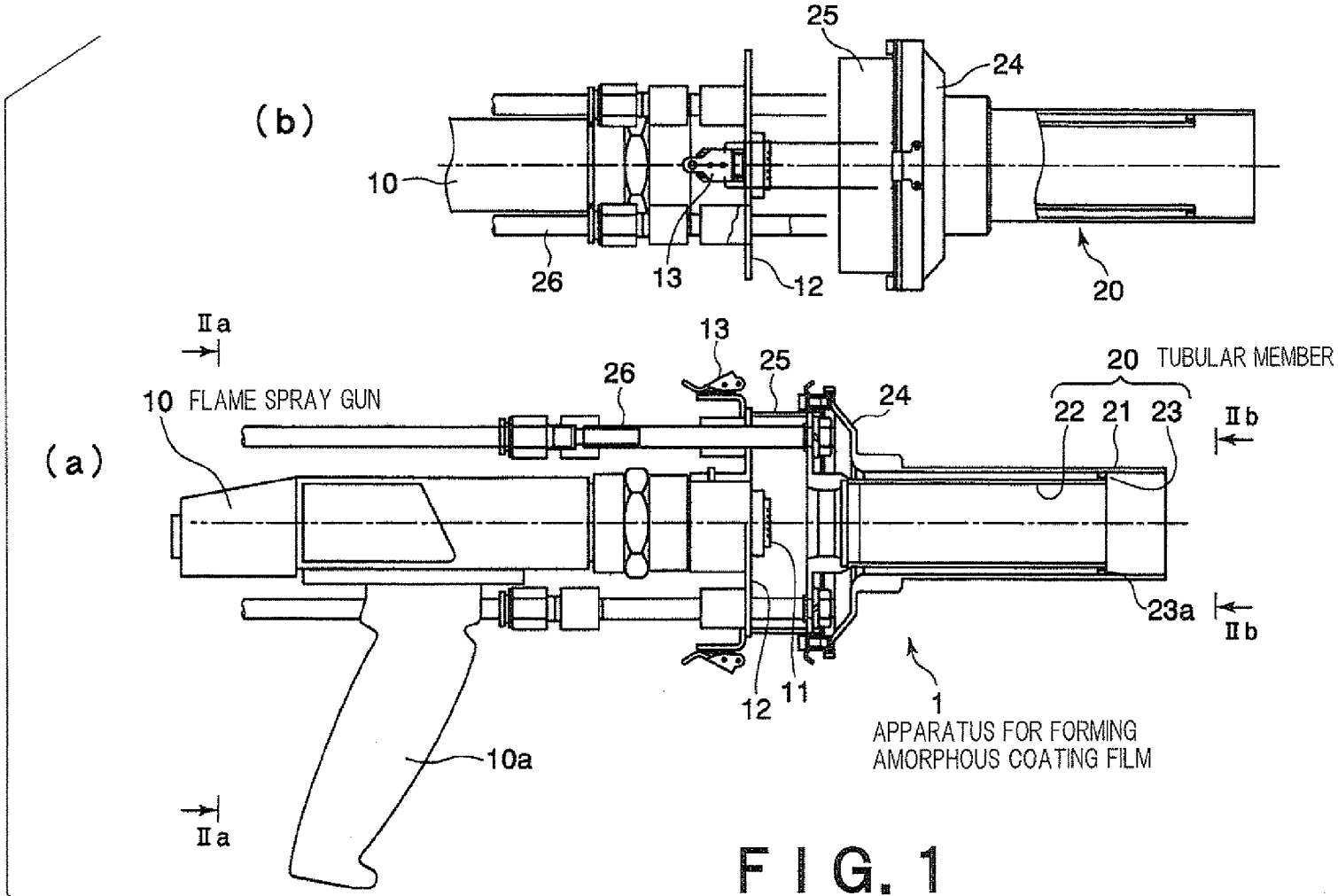
FIG. 1 is a view showing the entire structure of an apparatus for forming an amorphous coating film 1, according to an embodiment of the present invention.
Figure 3:
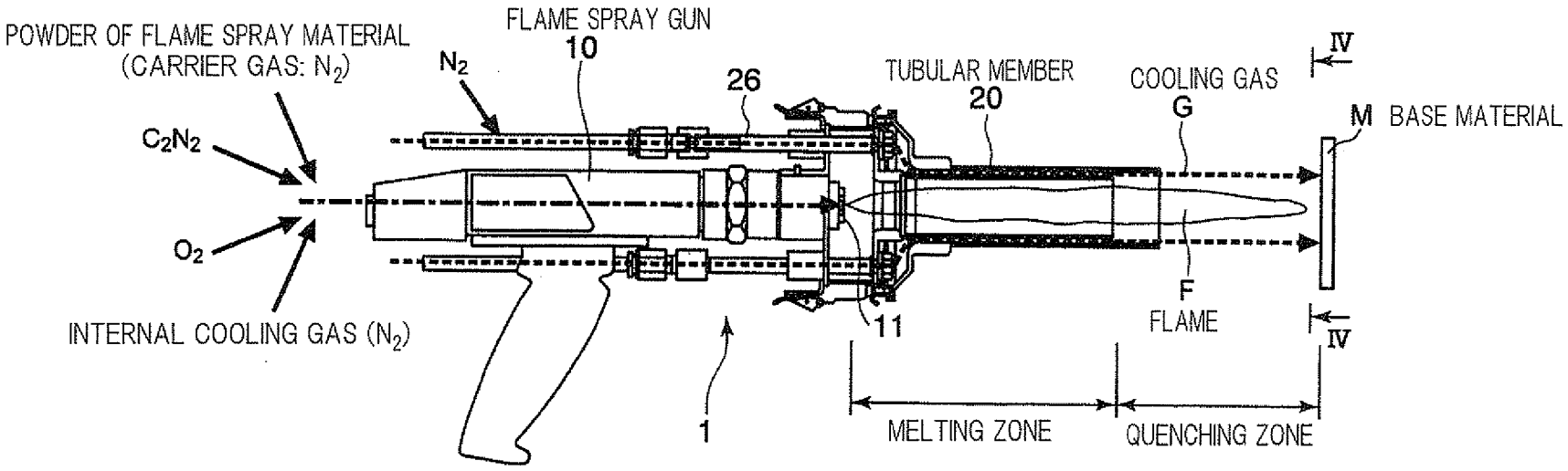
FIG. 3 is a side view showing the apparatus for forming an amorphous coating film 1 in operation.

As FIG. 1 shows, an apparatus for forming an amorphous coating film 1, according to an embodiment of the present invention, comprises a powder flame spray gun 10 having a handle or grip 10*a*, and a tubular member 20, etc. (that may also be called an external cooling device) attached to the front of the flame spray gun 10. Although not illustrated in the figure, a tube for feeding powder of a flame spray material along with a carrier gas (e.g., a nitrogen gas), tubes for respectively feeding an acetylene gas and an oxygen gas to be used as fuel, and a tube for feeding an internal cooling gas (e.g., a nitrogen gas) are connected to the flame spray gun 10. The flame spray gun 10 has, at its mouth, a nozzle 11 from which flame F and the melted material (the above powder that has been melted) are jetted, as shown in FIG. 3. The internal cooling gas is ejected from a or more positions in contact with the periphery of the nozzle 11, thereby cooling the nozzle 11 and controlling the temperature of the flame F. A front plate 12 in the shape of a flange is fixed to the flame spray gun 10 so that it is situated in the vicinity of the mouth of the flame spray gun 10 and around the nozzle 11. The tubular member 20 is attached to the flame spray gun 10 with the use of the front plate 12.

The tubular member 20 shown in FIG. 1 is for shielding, from the atmospheric air, the flame F jetted from the flame spray gun 10, at the first half of the path along which the flame is jetted, namely in a melting zone, in which the flame spray material powder is melted, and also for ejecting the cooling gas (e.g., a nitrogen gas) G from its distal end 23 toward the latter half of the path along which the flame is jetted (see FIG. 3). In this embodiment, stainless-steel-made two coaxial cylindrical pipes are used for the tubular member 20; an outer pipe 21 and an inner pipe 22 are coaxially arranged to form a space between them. This space serves as a flow channel for the cooling gas, and the distal end 23 as an opening through which the cooling gas is ejected. Since the cooling gas is allowed to flow between the two pipes (outer pipe 21 and inner pipe 22), the rise in temperature of the inner pipe 22 is suppressed. At the distal end 23 of the tubular member 20, the distal end of the outer pipe 21 is jutting (extending) over that of the inner pipe 22. The cooling gas is therefore guided to the vicinity of the distal end of the outer pipe 21 to be ejected in a direction parallel to the flame F, forming a continuous cylindrical flow. Partition members 23*a* that also serve to hold the two pipes coaxial are attached at the distal end 23 to form a plurality of slits 23*b* (see FIG. 2(*b*)). The sectional area of the openings between the distal ends of the two pipes is therefore smaller than that of the space between bodies of the two pipes. This serves to increase the flow rate of the cooling gas.

The outer pipe 21 and the inner pipe 22 of the tubular member 20 are connected to a holder 24 by screws that are provided at their respective proximal ends. The holder 24 is made of stainless steel and is hollow. The holder 24 has, at its front end, a joint for the outer pipe 21 and another joint for the inner pipe 22. A screw of the outer pipe 21, which is male, is connected to the former joint, and a screw of the inner pipe 22, which is female, is connected to the latter joint. By doing so, even if the cooling gas slightly leaks from around the screws, the leaking gas flows in the same direction as that of the flame, so that it never disturbs the flow of the flame.

The holder 24 has a plate on its rear (on the left-hand side in FIG. 1), and a plurality of tubes 26 made of stainless steel are connected to the plate. A nitrogen gas as a cooling gas is fed through these tubes 26 to the proximal end of the tubular member 20. Passing through the tubes 26, the cooling gas G enters the holder 24. After this, the cooling gas G passes through the space between the outer pipe 21 and the inner pipe 22 of the tubular member 20 and ejects from the distal end 23.

A cylindrical cover 25 is fixed to the rear of the holder 24 to connect the flame spray gun 10 and the tubular member 20, as shown in FIG. 1(*a*), and to close the inner space. The flame spray gun 10 and the tubular member 20 are held connected by means of a connecting metal fitting (lock) 13 shown in the figures. The cover 25 prevents the flame F from coming into contact with the atmospheric air and also serves to form a space useful for introducing the atmospheric air smoothly.

It is difficult to ignite the fuel for starting flame spray coating under a state wherein the tubular member 20 and the flame spray gun 10 are connected to each other to close the inner space. Therefore, the vicinity of the proximal end of the tubular member 20 is made openable. Specifically, the tubular member 20 including the cover 25 is made such that it can slide forward, away from the flame spray gun 10, with the connecting metal fitting 13 removed, as shown in FIG. 1(*b*). In order to make the tubular member 20 slidable as described above, the tubes 26 are slidably passed through respective holes made in the front plate 12 of the flame spray gun 10. Guided by the tubes 26, the tubular member 20, etc. can slide as described above. In other words, the four tubes 26 serve to feed a nitrogen gas as a cooling gas, and also to guide the back-and-forth movement of the tubular member 20, etc. After the tubular member 20 sliding forward, the fuel is ignited by putting a lighter close to the fuel (or by means of a sparkplug provided on the front part of the flame spray gun 10), while allowing the cooling gas to flow in a small amount. Then the flame spray gun is made to jet flame F on a full scale, and an increased amount of the cooling gas is allowed to flow. The tubular member 20 is made to slide backward so as to close the inner space, and the connecting metallic fitting 13 is locked.

A variety of flame spray materials with different melting points can be used for flame spray coating, and the length of the melting zone in which a flame spray material is melted (see FIG. 3) varies depending on the material, so that it is advisable to prepare a plurality of tubular members 20 having different lengths. As mentioned previously, the outer pipe 21 and the inner pipe 22, making up the tubular member 20, are connected to the holder 24 by the screws provided on the proximal ends of the two pipes. It is therefore possible to detach the two pipes 21, 22 easily from the holder 24 by rotating the two pipes 21, 22 in a specific direction, and attach other two pipes 21, 22 to the holder 24.

Figure 2:
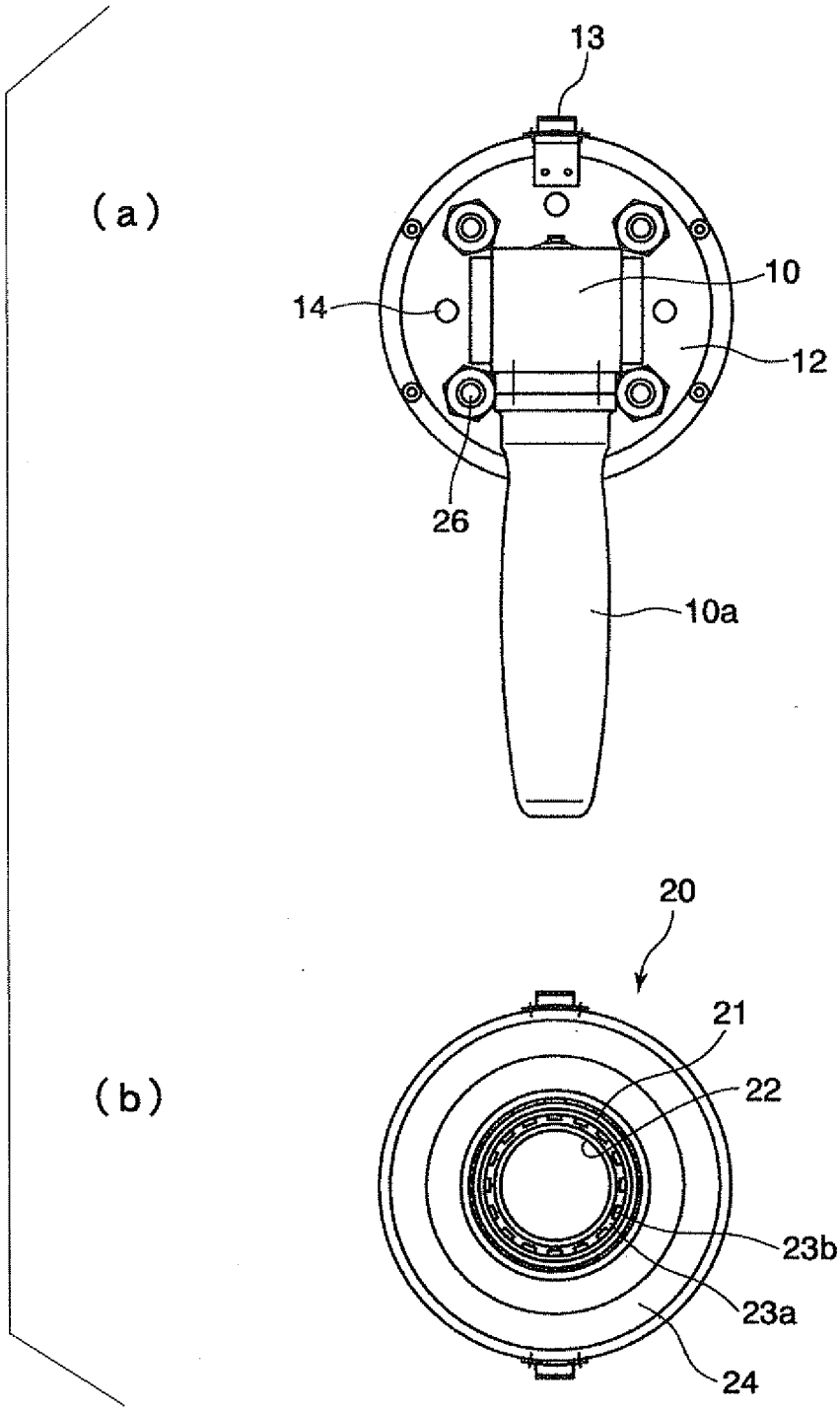
FIG. 2(*a*) is a view taken in the direction of the arrows IIa-IIa in FIG. 1(*a*), and FIG. 2(*b*) a view taken in the direction of the arrows IIb-IIb in FIG. 1(*a*).

If the cooling gas G is ejected at a high flow rate, a negative pressure is developed in the vicinity of the nozzle 11 of the flame spray gun 10 and also in the tubular member 20, disturbing the flow of the cooling gas, which leads to deposition of the flame spray material on the inner surface of the tubular member 20, etc., which sometimes hampers the continuous operation of the apparatus. In order to solve this problem, air-intake vents 14 are provided in the front plate 12 of the flame spray gun 10 in the apparatus 1, as shown in FIG. 2. These vents 14 allow air to flow into the tubular member 20 in a proper amount thereof depending on the inner pressure of the tubular member 20, thereby suppressing the development of a negative pressure.

With the use of the apparatus 1 shown in FIGS. 1 and 2, it is possible to form an amorphous coating film on the surface of a base material M, as shown in FIG. 3. Being surrounded first by the tubular member 20 and then by the cooling gas (a nitrogen gas) ejected from the distal end of the tubular member 20, the flame F jetted from the flame spray gun 10 through its nozzle 11 reaches the base material M. The amorphous coating film formed on the surface of the base material M, therefore, contains little oxides.

Figure 4:
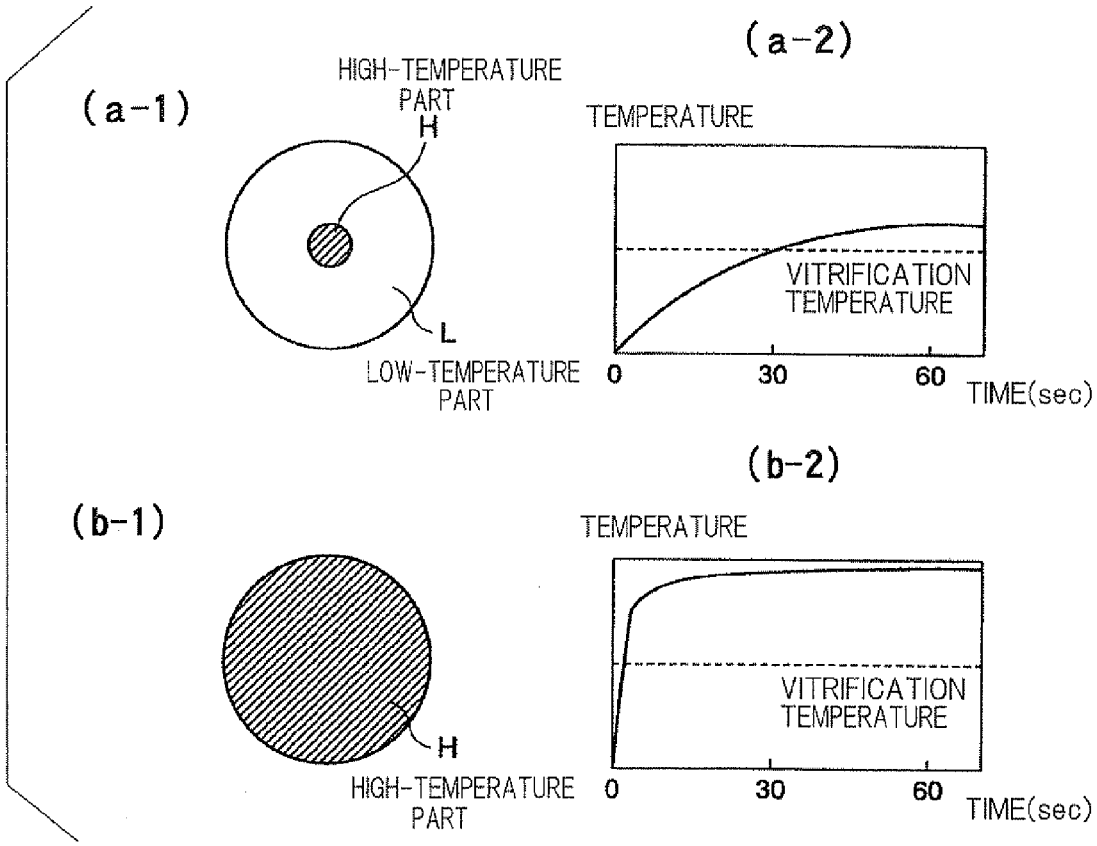
FIG. 4(*a*-1) shows a temperature distribution of flame F, on the vertical section shown by the arrows IV-IV in FIG. 3, and FIG. 4(*b*-1) shows a temperature distribution of flame, jetted in conventional powder flame spray coating, on the same section as the above.

FIG. 4(*a*-1) shows a temperature distribution of flame F on the vertical section IV-IV in FIG. 3. FIG. 4(*b*-1) shows a temperature distribution of flame in conventional powder flame spray coating, on the same section as the above. In the case where the apparatus 1 shown in FIGS. 1 to 3 is used, the center part (within a diameter of about 10 mm) of the flame F is a high-temperature part H (a part with a temperature higher than the vitrification temperature of the metal used as a flame spray material), and the outer part surrounding the center part is a low-temperature part L (a part with a temperature equal to or lower than the said vitrification temperature). In conventional powder flame spray coating, on the other hand, the entire part of the flame within a diameter of about 30 mm or more, including the center part, is a high-temperature part H with a temperature higher than the said vitrification temperature, as shown in FIG. 4(*b*-1).

If the flame F has the low-temperature part L around the high-temperature part H, as shown in FIG. 4(*a*-1), the rise in temperature of the base material M is mild as shown in FIG. 4(*a*-2) when the flame F is continuously applied to a certain part of the surface of the base material M, and the temperature of the center of this part to which the flame F has been applied does not reach the said vitrification temperature for about 30 seconds. If the high-temperature part H of the flame F is large as shown in FIG. 4(*b*-1), the temperature of the base material M rapidly increases as shown in FIG. 4(*b*-2) when the flame F is continuously applied to a certain part of the surface of the base material M, and the temperature of the center, etc. of this part exceeds the said vitrification temperature within several seconds. Therefore, in order to form an amorphous coating film by conventional powder flame spray coating, it is necessary to cool the base material M intensely, or to move the apparatus (flame spray gun) relative to the base material M in a direction parallel to the surface of the base material M at a high velocity, or to select a flame spray material only from metals whose melting points are low and whose abilities to become amorphous are great. On the other hand, the use of the apparatus 1 shown in FIGS. 1 to 3 is not subject to these restrictions, or eases them greatly.

The followings are the inventors' findings obtained from some tests with the use of the apparatus 1.

Figure 5:
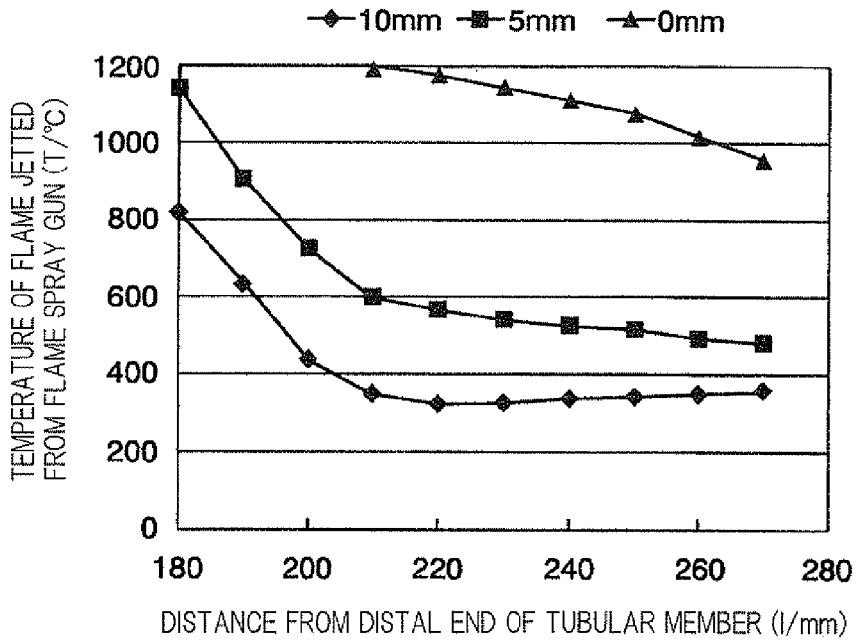
FIG. 5 is a graph showing a temperature gradient of flame F between the distal end of the tubular member 20 and the base material M.

1. FIG. 5 is a graph showing the temperature gradient of flame (F) between the distal end of the cylindrical nozzle of the external cooling device (tubular member 20) attached to the mouth of the flame spray gun (10), and an object to be coated by flame spray coating (base material M). In the diagram, the curve at "0 mm" shows the temperature gradient of the flame at its center, and the curves at "5 mm" and "10 mm" are the temperature gradients of the flame at the points 5 mm and 10 mm apart from the center, respectively. This graph shows the following: the temperature of the flame at its center is almost 1000° C. when the flame strikes the object, whereas the temperatures of the flame at the points slightly apart from the center are much lower than the temperature at the center when the flame strikes the object; about 500° C. at the point 5 mm apart from the center, and about 300° C. at the point 10 mm apart from the center. This shows that when the flame strikes the base material, its temperature gradient is doughnutlike.

Figure 6:
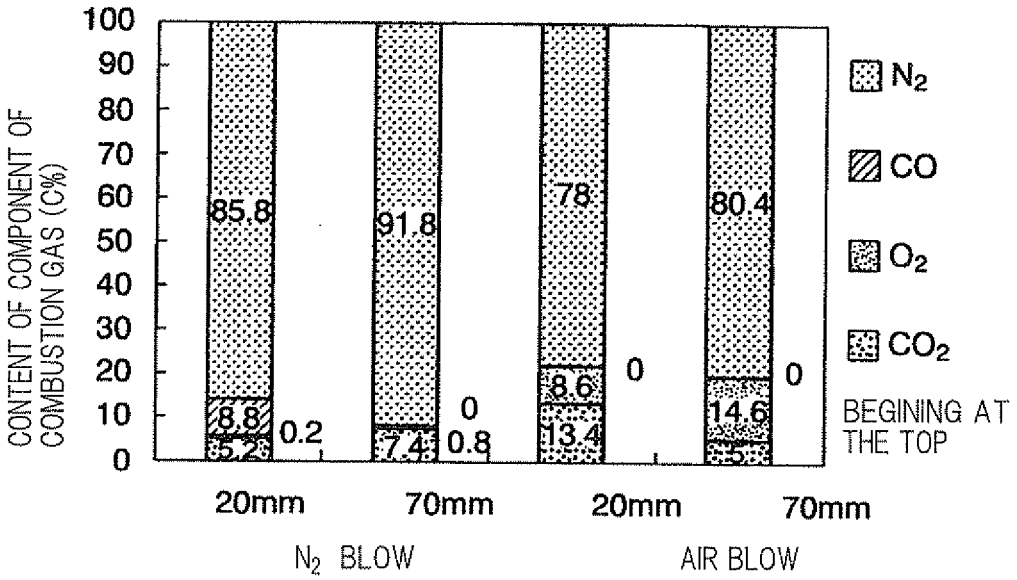
FIG. 6 is a graph showing the ratio of components of a combustion gas at several points ahead of the distal end of the tubular member 20.

2. FIG. 6 is a graph showing the ratio of components of a combustion gas at the points 20 mm and 70 mm apart from the distal end of the external cooling device (20) attached to the mouth of the flame spray gun (10). In this graph, the bar with the caption "air blow" shows the ratio of components of the combustion gas when air is used for external cooling, and the bar with the caption "$N_2$ blow" shows the ratio of components of the combustion gas when a nitrogen gas is used for external cooling. Combustion condition of flame is tested with fuel-rich flame with a little $O_2$, so-called reducing flame. Under the condition of "air blow", the combustion gas has high $O_2$ and $CO_2$ contents at the points 20 mm and 70 mm apart from the distal end of the external cooling device. Under the condition of "$N_2$ blow", on the other hand, the combustion gas has a high CO content and an extremely low $O_2$ content at the point 20 mm apart from the distal end of the external cooling device, and has high $N_2$ and $CO_2$ contents and a low $O_2$ content at the point 70 mm apart from the distal end of the external cooling device. These results show the following: if flame spray coating is conducted under the "$N_2$ blow" condition, a flame spray material is shielded with a combustion gas having a low $O_2$ content, so that the production of oxides can be suppressed.

Figure 7:
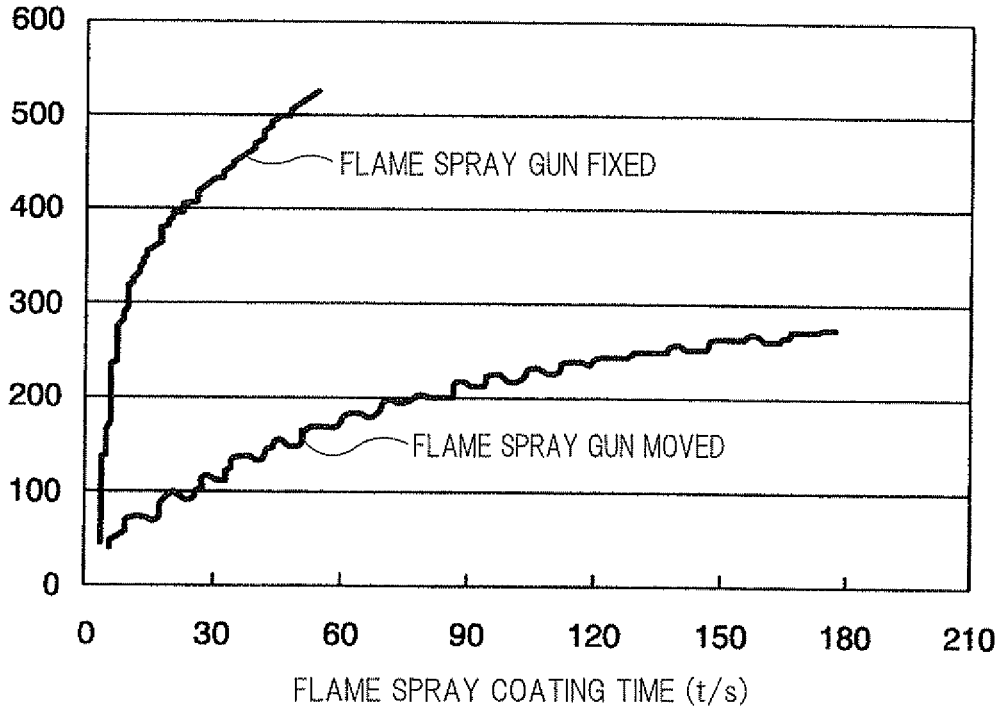
FIG. 7 is a graph showing a temperature rise gradient of the base material M when a flame spray coating film is formed on it.

3. FIG. 7 is a graph showing a temperature gradient of an object (M) to be coated by flame spray coating, obtained with the use of a thermal pair embedded in the object (M), when flame spray coating is conducted by the use of the apparatus having the external cooling device (20) attached to the mouth of the flame spray gun (10). In the graph, the curve with the caption "flame spray gun fixed" shows a temperature gradient of the object, in the case where the flame spray gun is fixed and flame is continuously and concentrically jetted (applied) to one spot on the object. The curve with the caption "flame spray gun moved" shows a temperature gradient of the object, in the case where flame is continuously applied to the object, with the flame spray gun moved at a velocity of 280 mm/s. In the case of "flame spray gun fixed", since the high-temperature part develops at the center part of the flame as described in the above item 1, the temperature of the object increases as the flame spray coating progresses, and it exceeds 500° C. about 60 seconds after the start of the flame spray coating. In the case of "flame spray gun moved", on the other hand, since the flame spray gun is moved at a high velocity, the low-temperature part of the flame, the high-temperature part of the flame, and the low-temperature part of the flame strike the object in this order. This is effective in suppressing the rise in temperature of the object. The graph shows that the temperature of the object is below 300° C. even 180 seconds after the start of the flame spray coating.

Figure 8:
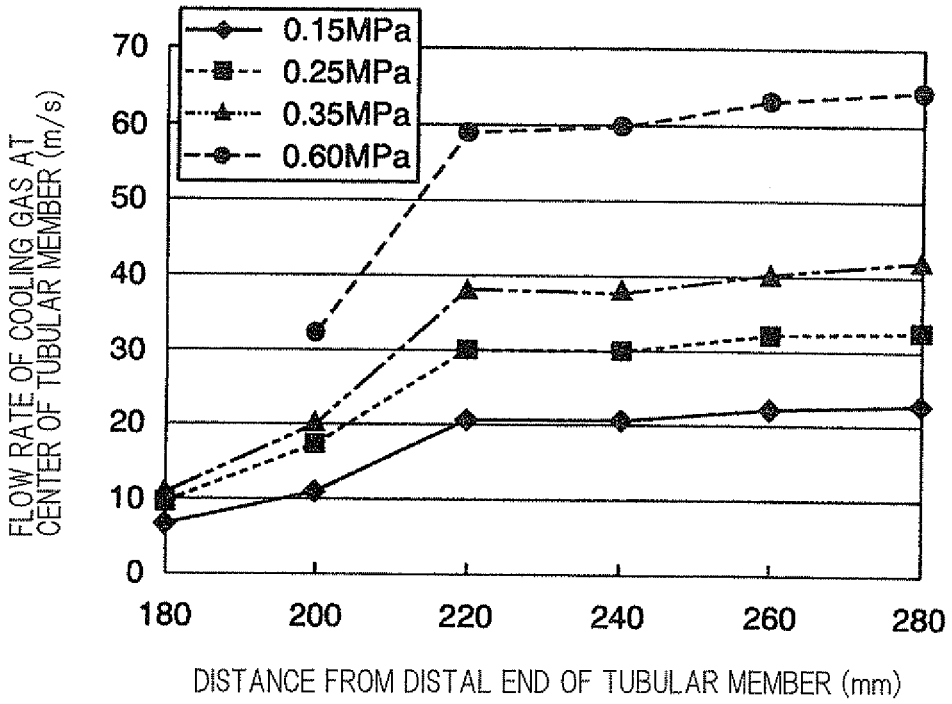
FIG. 8 is a graph showing flow rates of a cooling gas G depending on pressure, measured at several points between the distal end of the tubular member 20 and the base material M.

4. FIG. 8 is a graph showing the flow rates of a cooling gas (G) depending on pressure, determined at several points between the distal end of the external cooling device (20) attached to the mouth of the flame spray gun (10) and an object (M) to be coated by flame spray coating. The flow rate of the flame (F) jetted from the flame spray gun is 30-40 m/s. In order to obtain cooling effects and also to make a flow of the cooling gas smooth, it is necessary to set the flow rate of the cooling gas higher than that of the flame. As can be understood from the graph, it is desirable that the pressure of the cooling gas be set at 0.25 MPa or more. However, if the pressure of the cooling gas is excessively increased, a negative pressure is developed in the tubular member. A flow of the cooling gas is thus disturbed, and particles of the flame spray material are deposited on the inner surface of the tubular member. This makes continuous operation of the apparatus impossible. In order to avoid this inconvenience, it is necessary to increase an intake of the atmospheric air so as to maintain the good balance of gas components, but this promotes the production of oxides. It is therefore understood that the optimum pressure of the cooling gas is in the vicinity of 0.25 MPa, at which the flow rate of the cooling gas gets close to that of the flame jetted from the flame spray gun.

Figure 9:
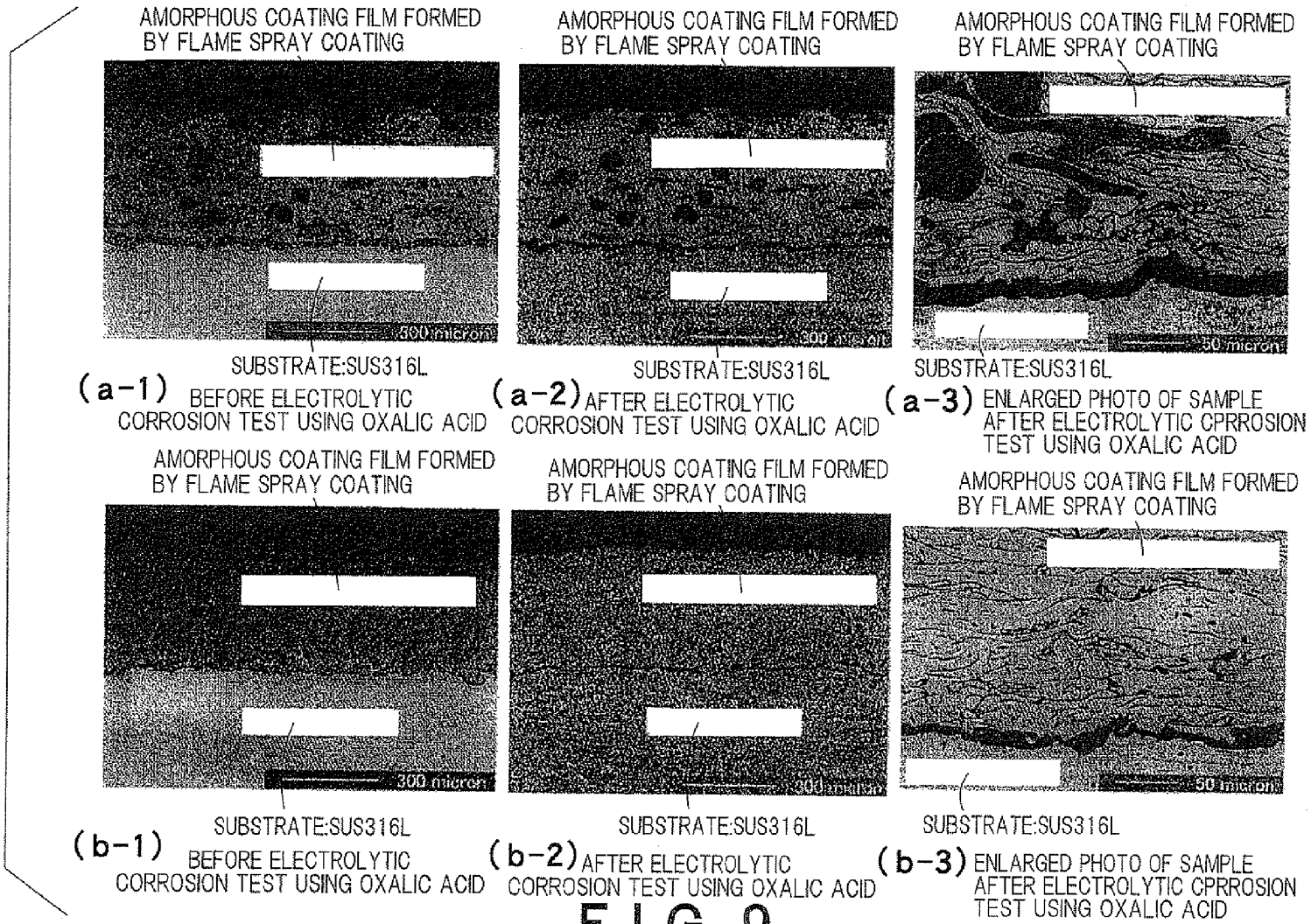
FIGS. 9 (*a*-1) to (*a*-3) are photomicrographs showing the results of an electrolytic corrosion test using oxalic acid, conducted on an amorphous coating film formed by a conventional apparatus.
Figure 12:
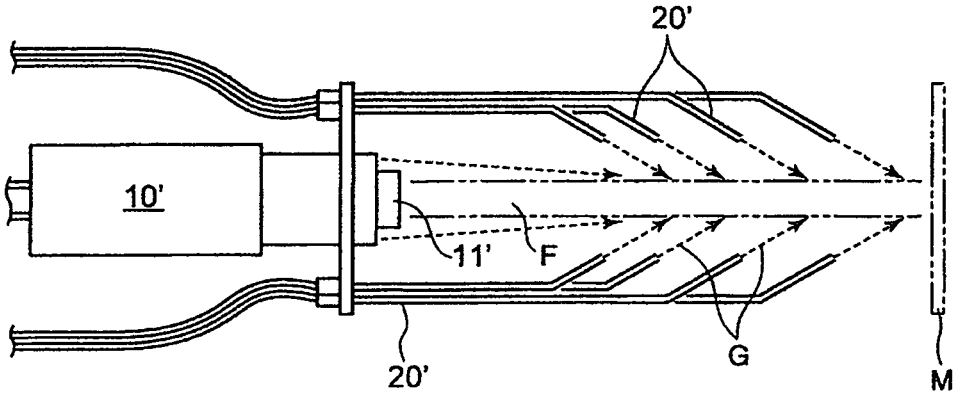
F I G. 12 Prior Art
FIG. 12 is a side view schematically showing a conventional apparatus for forming an amorphous coating film.

5. FIGS. 9(*a*-1) to 9(*a*-3) are photos showing the results of the electrolytic corrosion test using oxalic acid, conducted on an amorphous coating film formed by a conventional apparatus shown in FIG. 12, having a conduit nozzle (20'). FIGS. 9(*b*-1) to 9(*b*-3) are photos showing the results of the electrolytic corrosion test using oxalic acid, conducted on an amorphous coating film formed by an apparatus according to the present invention, having the above-described external cooling device (20). When the conventional apparatus with the conduit nozzle is used, the particles come into contact with the atmospheric air, so that the amorphous coating film formed unfavorably contains oxides and non-melted particles. On the other hand, when the apparatus according to the invention, having the above-described airtight, cylindrical external cooling device (20) is used, the amorphous coating film formed does not contain non-melted particles, and the amount of oxides present in the film is suppressed. Thus, the amorphous coating film formed by the apparatus according to the invention is of high grade.

6. The following table 1 shows the results of the corrosion resistance test conducted on an amorphous coating film formed (only an amorphous coating film peeled off from a base material), as well as on Hastelloy C and on titanium as reference samples. The amorphous coating film, the Hastelloy C and the titanium were simultaneously immersed in various corrosive liquids for four weeks, and the changes in weight of these samples were determined. According to the criteria for evaluating the corrosion resistance of chemical plants, when a sample undergoes only such a decrease in weight as 0 to −0.5 g/m$^2$ day, it is evaluated as highly resistant to corrosion. As for the amorphous coating film, initial increase in weight due to the production of an oxide layer was observed, but almost no corrosion developed after it. On the other hand, the Hastelloy C and titanium corroded. It is obvious that the amorphous coating film has higher resistance to corrosion than Hastelloy C and titanium.

TABLE 1

Results of Corrosion Resistance Test

| corrosive | | | immersion | amorphous | change in weight (g/m$^2$day) references | |
|---|---|---|---|---|---|---|
| liquid | concentration | temperature | time | coating film | Hastelloy C | titanium |
| hydrochloric acid | 35% | normal temp. | 6 hours | −7890 | −4.56 | −312 |
| nitric acid | 10% | " | 4 weeks | +0.065 | 0 | −0.004 |
| sulfuric acid | 5% | " | 4 weeks | +0.049 | 0 | −0.013 |
| sulfuric acid | 70% | " | 4 weeks | −0.011 | −0.013 | −0.117 |
| caustic soda | 48% | " | 4 weeks | +0.024 | −0.008 | −0.004 |
| hypochlorous acid soda | 12% | " | 4 weeks | +0.079 | 0 | 0 |
| saline solution | 3% | " | 4 weeks | +0.154 | 0 | 0 |
| phosphoric acid | 5% | " | 4 weeks | +0.100 | — | — |

Figure 10:
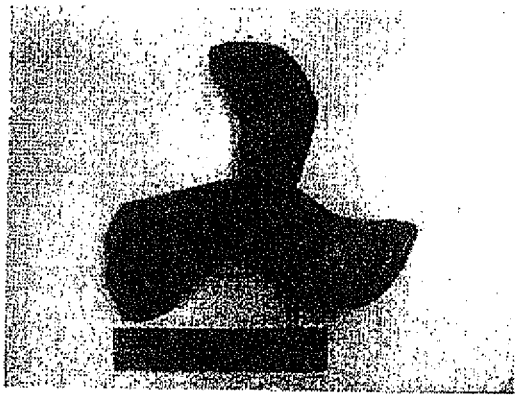
FIGS. 10(*a*) and 10(*b*) are photos taken in the tests for evaluating the corrosion and abrasion resistance with the use of an agitator installed in a chemical fertilizer factory.
Figure 10:
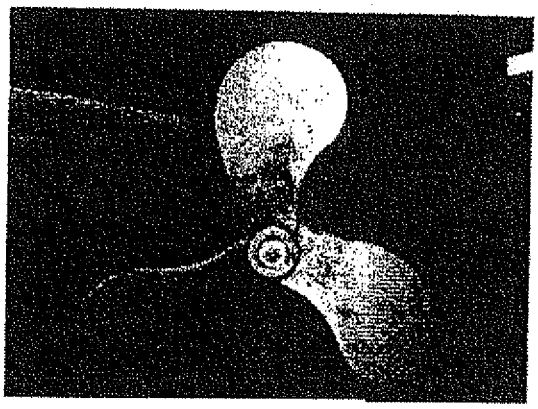

Note)
Criteria for evaluating the corrosion resistance of chemical plants: 0 to −0.5 g/m$^2$day = highly resistant 7. An amorphous coating film was formed on an impeller for an agitator in a production line in a chemical fertilizer factory by the use of the apparatus according to the invention, having the above-described external cooling device (20), and a verification test was conducted on the impeller. The test conditions and the test results are shown below. The external appearance of a conventional impeller for the above agitator and that of the impeller coated with the amorphous coating film by the use of apparatus according to the invention, after their use for a certain period of time, are shown in FIG. 10. FIG. 10(*a*) is a photo showing the state of abrasion on the conventional impeller for the agitator that was used for pH 2 slurry pit, and FIG. 10(*b*) is a photo showing the state of abrasion on the impeller coated with the amorphous coating film that was used in the same manner as the conventional impeller.

[test specification] surface: highly resistant material $Fe_{70}Cr_{10}P_{13}C_7$ 300 μm

[test circumstance] an agitator in a production line in a chemical fertilizer factory

[performance requirement] corrosion resistance and abrasion resistance in pH 2 slurry

[conventional material] SUS316L

Decrease ratio in weight by abrasion

Impeller made of conventional material SUS316L after 11 months: 62%

(after 5 months: 28% (calculated))

Impeller coated with amorphous coating film After 5 months: 2%

The decrease ratio in weight by abrasion of the conventional impeller made of SUS316L was 62% after use for 11 months (after use for 5 months, obtained by calculation: 28%), as described above. On the other hand, the decrease ratio in weight by abrasion of the impeller coated with the amorphous coating film was 2% after use for 5 months. These results show that the resistance to corrosion and abrasion of the impeller coated with the amorphous coating film is 14 times greater than that of the conventional impeller.

Figure 11:
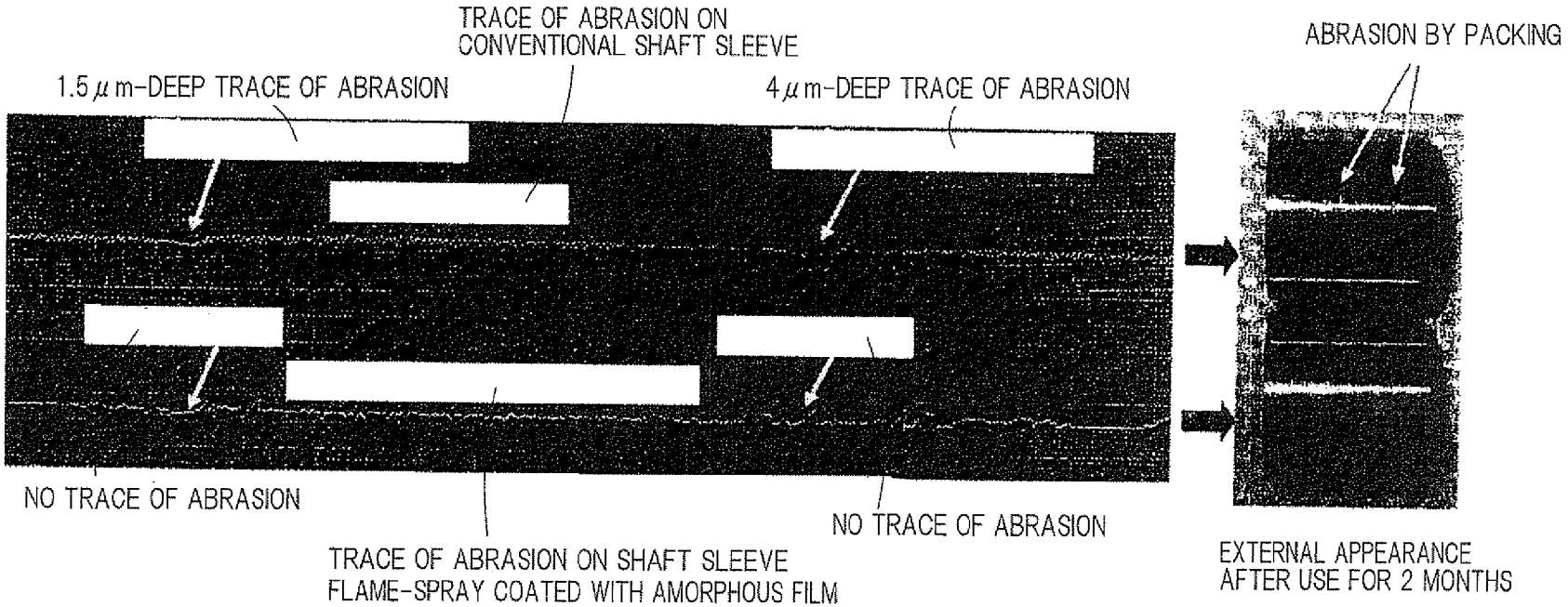
FIG. 11 is an illustration and a photo showing the state of abrasion on a pump shaft sleeve with or without an amorphous coating film after use for pH 2 slurry.

8. Further, an amorphous coating film was formed on a shaft sleeve for a slurry pump in a production line in a chemical fertilizer factory by the use of the apparatus according to the invention, having the above-described external cooling device (20), and a verification test was conducted on the shaft sleeve. The test conditions are shown as follows. The state of abrasion and others are shown in FIG. 11.

[test specification] base: NiCr 50 μm surface: highly resistant material $Fe_{70}Cr_{10}P_{13}C_7$ 150 μm

[test circumstance] a slurry pump in a production line in a chemical fertilizer factory

[performance requirement] corrosion resistance and abrasion resistance in pH 2 slurry

[conventional materials] titanium, Hastteloy, Durimet 20, SUS316L

A test sample was prepared by making a shaft sleeve for the above pump from SUS304, forming an amorphous coating film on the surface of the shaft sleeve, and subjecting the surface to diamond polishing. This test sample was set on a conventional slurry pump, and a verification test was carried out. As FIG. 11 shows, a 4 μm-deep trace of abrasion and corrosion caused by packing and slurry was observed on a conventional Durimet-made shaft sleeve after use for 2 months. No trace of abrasion or corrosion, on the other hand, was observed on the shaft sleeve coated with the amorphous coating film after use for 2 months. This shows that the shaft sleeve coated with the amorphous coating film has higher resistance to corrosion and abrasion than the conventional shaft sleeve made of Durimet.

Although the preferred embodiment of the present invention has been somewhat specifically described above, it will be obvious to those skilled in the art that various modifications and alterations may be made to it. It should, therefore, be understood that the present invention can be embodied in other forms than those specifically described in the specification without departing from its scope and spirit.

The invention claimed is:

1. An apparatus for forming an amorphous coating film by jetting flame containing particles of a flame spray material from a flame spray gun toward a base material, causing the particles to be melted by the flame, and cooling both the particles and the flame by means of a cooling gas before they reach the base material, the apparatus comprising a tubular member provided at a melting zone, in which the particles are melted, among a path along which the flame is jetted by the flame spray gun, so as to shield the flame from an atmospheric air in the melting zone, the tubular member having a flow channel for the cooling gas, formed along and integrally to the tubular member, the apparatus having, between the tubular member and the flame spray gun, air-intake vents or inert-gas-feed openings configured to suppress development of a negative pressure in the tubular member, wherein the tubular member has a proximal end which is connected to the flame spray gun, and the proximal end or the vicinity thereof is operable between an opened condition for an ignition of the flame spray gun and a closed condition.

2. An apparatus for forming an amorphous coating film by jetting flame containing particles of a flame spray material from a flame spray gun toward a base material, causing the particles to be melted by the flame, and cooling both the particles and the flame by means of a cooling gas before they reach the base material, the apparatus comprising a tubular member provided at a melting zone, in which the particles are melted, among a path along which the flame is jetted by the flame spray gun, so as to shield the flame from an atmospheric air in the melting zone, wherein the tubular member has coaxial two cylindrical pipes whose distal ends are open such that the cooling gas flows between the two pipes and ejected from between the distal ends of the two pipes to flow tubularly around an entire periphery of the flame, and a sectional area of the opening between the distal ends of the two pipes is smaller than that of the opening between bodies of the two pipes.

3. The apparatus for forming an amorphous coating film according to claim 1, wherein the cooling gas is a nitrogen gas or an inert gas.

4. The apparatus for forming an amorphous coating film according to claim 1, wherein the tubular member is replaceable with one having a different length.

5. The apparatus for forming an amorphous coating film according to claim 1, wherein the apparatus is configured such that a temperature of an outer part of the flame, surrounding a center part of the flame within a diameter of 10 mm, is not higher than a vitrification temperature of a metal that is used in the form of particles of the flame spray material, when the flame reaches the base material.

6. A method of forming an amorphous coating film, comprising:

jetting flame containing particles of a flame spray material from a flame spray gun through a tubular member and toward a base material, causing the particles to be melted by the flame, and cooling both the particles and the flame by means of a cooling gas before they reach the base material such that a surface temperature of the specific part of the base material is kept at a temperature equal to or lower than a vitrification temperature of a metal that is used in the form of particles of the flame spray material, for a period of 10 seconds or more, wherein the tubular member is provided at a melting zone, in which the particles are melted, among a path along which the flame is jetted by the flame spray gun, so as to shield the flame from an atmospheric air in the melting zone, the tubular member has a flow channel for the cooling gas, formed along and integrally to the tubular member, and the tubular member has a proximal end which is connected to the flame spray gun, and the proximal end of the vicinity thereof is operable between an opened condition for an ignition of the flame spray gun and a closed condition, and air-intake vents or inert-gas-feed openings configured to suppress development of a negative pressure in the tubular member are located between the tubular member and the flame spray gun.

7. The method of forming an amorphous coating film according to claim 6, further comprising cooling the base material with the use of the cooling gas such that a surface temperature of the specific part of the base material can be kept at a temperature equal to or lower than a vitrification temperature of a metal that is used in the form of particles of the flame spray material, for a period of 10 seconds or more.

8. The method of forming an amorphous coating film according to claim 6, further comprising moving the apparatus for forming an amorphous coating film relative to the base material in a direction parallel to a surface of the base material while conducting cooling, such that the surface temperature at any spot on the base material does not exceed a vitrification temperature of a metal that is used in the form of particles of the flame spray material.

9. The apparatus for forming an amorphous coating film according to claim 2, wherein the two cylindrical pipes consist of an inner pipe and an outer pipe, the distal end of the outer pipe is jutting over that of the inner pipe.

* * * * *